US006045465A

United States Patent [19]

Alfano et al.

[11] Patent Number: 6,045,465

[45] Date of Patent: Apr. 4, 2000

[54] BASEBALL TRAINING BAT WITH COLORED TRANSFERABLE BANDS

[76] Inventors: Robert R. Alfano; Scott A. Alfano, both of 3777 Independence Ave., Bronx, N.Y. 10463

[21] Appl. No.: 09/054,694

[22] Filed: Apr. 3, 1998

Related U.S. Application Data

[60] Provisional application No. 60/042,586, Apr. 3, 1997.

[51] Int. Cl.[7] ..... A63B 69/00

[52] U.S. Cl. ..... 473/457; 473/422; 473/453; 473/559; 473/564

[58] Field of Search ..... 473/417, 420, 473/451, 453, 456, 457, 458, 465, 468, 499, 500, 559, 560, 564, FOR 103, 102; 273/108.3, 457

[56] References Cited

U.S. PATENT DOCUMENTS

| | | | |
|---|---|---|---|
| 2,660,436 | 11/1953 | Grossman | 473/237 |
| 3,246,894 | 4/1966 | Salisbury | 473/457 |
| 3,268,226 | 8/1966 | Martino | 473/457 |
| 3,618,945 | 11/1971 | Kuchar | 473/457 |
| 4,637,616 | 1/1987 | Whiting | 473/577 |
| 4,676,508 | 6/1987 | Dilny | 473/237 |
| 4,991,838 | 2/1991 | Groves | 473/451 |

*Primary Examiner*—Jeanette Chapman
*Assistant Examiner*—Michael Chambers
*Attorney, Agent, or Firm*—Kriegsman & Kriegsman

[57] ABSTRACT

A baseball bat which includes one or more colored bands with transferrable colored pigments in or adjacent to the hitting zone to assist a batter in determining where a ball is hit on the hitting zone of the bat. The colored bands on the bat have a color pigment that will mark the ball when hit. The marked ball will provide an indication of where the bat impacted the ball. This information can be used to better train the players in hitting the balls.

5 Claims, 2 Drawing Sheets

BASEBALL TRAINING BAT WITH COLORED TRANSFERABLE BANDS

CROSS-REFERENCE TO RELATED APPLICATION

This application claims the priority of provisional patent application No. 60/042,586 filed on Apr. 3, 1997.

BACKGROUND OF THE INVENTION

The present invention relates to baseball bats and more particularly to a baseball training bat.

In baseball, one of the major problems in becoming a superior hitter is for the hitter to keep one eye on the ball as the ball hits the bat. Upon swinging, most hitters do not really see the ball hit the bat. The hitter needs to be trained to focus his eyes on the ball when it is released from the pitcher and follow it as it crosses home plate. Once the hitter determines the ball is near or in the hitting region, the hitter needs to swing and make contact. During the swing, the hitter needs to watch the ball hit the bat. In the major leagues, a hitter has typically ½ a second to determine to swing and hit the ball. In little league, the hitting time is on the order of 1 to 2 second range. The hitter needs to learn how to adjust the timing of the swing. More importantly, he needs to be trained and learn to see the bat move in front of the plate to meet the ball. The batter needs to keep his eyes focused down upon hitting the ball. It is common that the hitter does not look at the ball as it passes near home plate.

SUMMARY OF THE INVENTION

It is an object of this invention to provide a new and improved training bat.

According to this invention a baseball bat is provided which includes one or more colored bands, the one or more colored bands being located adjacent or in the hitting zone of the bat.

DETAILED DESCRIPTION OF PREFERRED EMBODIMENTS

This invention teaches how to improve hitting by training a hitter from the major to little leagues to focus one eye to see the bat hit the ball. The invention comprises a baseball bat having one or more colored rings or bands located on the hitting zone of the bat. The hitting zone of the bat has also been called the sweet portion, joy spot, or happy zone and is located on a 4½ inch section on the upper portion of the bat. Details regarding the happy zone may be found in the Science of Hitting, Ted Williams and John Underwood, a Fireside Book, Simon & Shuster, New York 1986. The rings or bands can be colored different colors, principally in the red, orange family. A pair of red colored rings or bands are ideal. By focusing on colored rings the hitter becomes more aware of seeing the ball hit the bat.

The brightly colored bands can be painted, taped or sprayed on the bat. The bat can be made of wood or metal. The colored bands are preferably fluorescent pigments e.g. red, orange or orange/red, such as for example, the Radiant JST-300 Series Thermoplastic Fluorescent Pigments made by Radiant Color Company of Richmond, Calif. These pigments can either be painted or sprayed directly onto the bat or provided on tape which is attached to the bat.

Different color rings on the bat were tested by a hitter using a metal bat.

Figure 1:
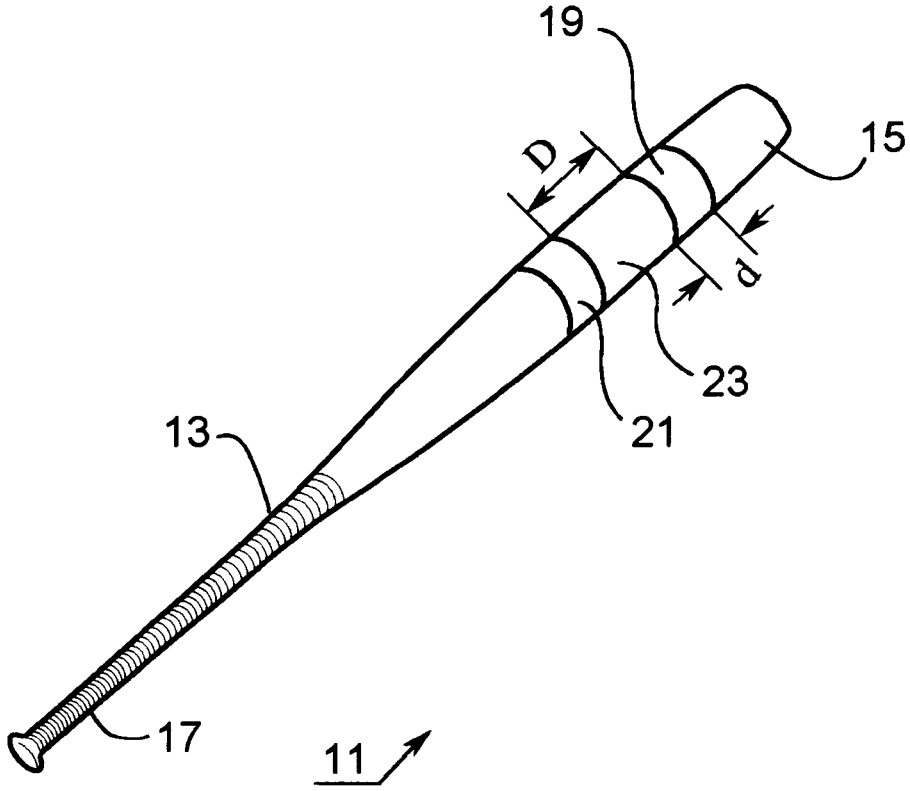
FIG. 1 is a perspective view of one embodiment of a baseball training bat according to this invention.

A perspective view of one embodiment of a training bat of this invention is shown in FIG. 1 and identified by reference numeral 11. Training bat 11 is an elongated club 13 having a head 15 and a handle 17. Bat 11 has two orange color bands 19 and 21, one on each side of the hitting zone 23.

Different shades of red or bright red are preferable for rings 19 and 21. It has been determined that red rings are seen better than blue or green on swinging. The best color can vary from person to person depending on the color sensitivity of the batter's eyes. Typically, the red family of color is best since the red sensitive cones of the eye are located over a wider portion of the retina. This pigment distribution over the retina gives a person a wider view angle for the batter to see the bat as it enters the hitting region to made better contact with the ball.

Figure 2:
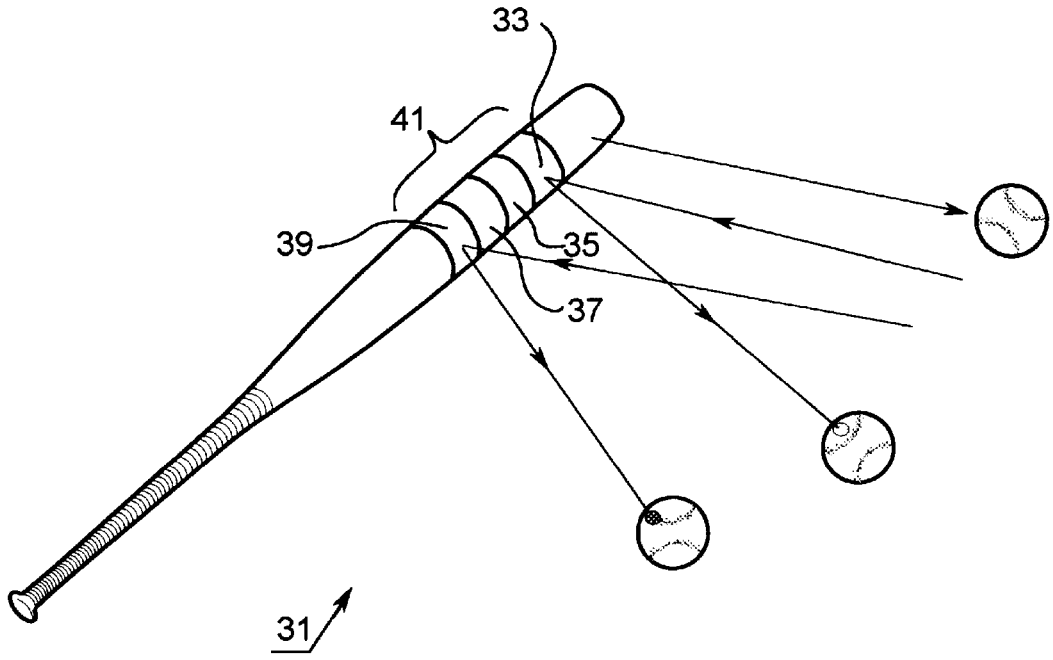
FIG. 2 is a perspective view of another embodiment of a baseball training bat according to this invention.

In FIG. 2 there is shown another training bat 31 according to this invention. In bat 31, there are four colored bands 33, 35, 37 and 39 in the hitting zone 41 of club 42. Bands 33, 35, 37 and 39 are Radiant JST-300 Series pigments and are sprayed onto bat 31. In use, a ball hitting red band 33 will have a red mark while a ball hitting blue band 39 will have a blue mark and so forth. Outside of hitting zone 41, the ball will have no colored mark. Instead of a plurality of color bands, one large color band can be used over entire hitting zone 41 to mark the ball upon hitting.

Using a bat with color bands allows the hitter to train him/her to better see the bat tit the ball. The color bands allow the hitter to better concentrate on the ball meeting the bat. In this way, he will become a better hitter.

SOME OF THE FEATURES OF THE INVENTION ARE AS FOLLOWS:

1. A training bat made of metal or wood with colored bands painted on it.
2. The bands or rings are different fluorescent colors made from pigments and either in the form of paint or tape.
3. The colors of the bands are any color in the visible spectrum.
4. The color band are a shade of the red and orange family.
5. The bands or rings are made of colored tape.
6. The tape to be colored is fabric, plastic, vinyl or soft material. The tape has bonding material on the underside to stick to the bat.
7. The size of bands or rings is ¼ minch to 5 inches wide located on the upper portion of the bat.
8. The number of bands or rings can be one, two or any number located on the upper part of the bat near the hitting zone. The sweet portion of the bat is the 4½ inch region located in the upper portion.
9. The location of the rings is on the upper portion of the bat.
10. The rings are located around or about the hitting zone of the bat about 4½ inch wide.
11. A colored tape may be used to tape on metal and/or wood bat to be located for training.
12. The design of tape may be a mixture of colors and black and white.
13. The color may be fluorescent and/or non-fluorescent pigments in paints or tape.

14. A soft sheet of colored tape positioned in the hitting zone may be used to locate where the hitter hits the ball.
15. The color bands may be white or black.
16. The white colored ring can be on a black or partially black bat.
17. The black colored ring can be on a white or partially white bat.
18. The bats used for rings are wooden or metal.
19. Various colored bats can be used with the colored rings.
20. The distance between rings or bands should be 1 inch to 5 inches.
21. The material of colored bands may be soft to locate where the ball hits the bat to confirm the hitting location.
22. The color media to be in bands is from fluorescent or absorption pigments.
23. Color fluorescent or absorption colored tape for use to be bonded to baseball bat to improve hitting.
24. Color fluorescent or absorption tape with stick-on material to bond to baseball bat.
25. Using color bands on the bat to determine the location where the ball hits the bat by the colors transferred from the color bands on the bat to the ball upon hitting. The ball will have the color it hits on the bat.
26. The color bands on the bat are used as a tool to determine whether the batter hit the correct region on the bat.
27. One large colored band, e.g. red or different color bands, e.g. red, orange, green, and blue can be used along the "hitting zone" to determine which region on the bat was hit form the color mark appearing on the face of the ball.
28. The balls can be washed with solvent or soap and water to remove the colored mark on the ball for additional use.

What is claimed is:

1. A baseball training bat comprising:

a. an elongated club having an upper portion, a section on the upper portion constituting a hitting zone, b. at least one colored band on the upper portion of the elongated club at said hitting zone, said at least one colored band comprising transferrable colored pigments, c. wherein, when a baseball hits the bat at the least one colored band, some of the colored pigments will be transferred from said colored band to said baseball, providing thereby a visual indication on said baseball that said baseball has hit said at least one colored band, said at least one colored band also serving to assist a batter holding the elongated club in seeing the ball hit the bat.

2. The baseball training bat of claim 1 wherein said colored pigments are red.

3. The baseball training bat of claim 1 wherein said at least one colored band comprises two colored bands of tape attached to said elongated club, one on each side of said hitting zone.

4. The baseball training bat of claim 1 wherein said at least one colored band is within said hitting zone.

5. The baseball training bat of claim 4 wherein said at least one colored band comprising a plurality of bands of different colors.

* * * * *